US012543830B2

(12) United States Patent
Powis

(10) Patent No.: US 12,543,830 B2
(45) Date of Patent: Feb. 10, 2026

(54) MULTIFUNCTIONAL DUAL CARRY BAG SYSTEM

(71) Applicant: Denise Powis, Copenhagen, NY (US)

(72) Inventor: Denise Powis, Copenhagen, NY (US)

( * ) Notice: Subject to any disclaimer, the term of this patent is extended or adjusted under 35 U.S.C. 154(b) by 0 days.

(21) Appl. No.: 18/816,418

(22) Filed: Aug. 27, 2024

(65) Prior Publication Data

US 2025/0295207 A1 Sep. 25, 2025

Related U.S. Application Data

(60) Provisional application No. 63/569,421, filed on Mar. 25, 2024.

(51) Int. Cl.
*A45C 7/00* (2006.01)
*A45C 3/06* (2006.01)
*A45C 13/30* (2006.01)

(52) U.S. Cl.
CPC ..... *A45C 7/0086* (2013.01); *A45C 3/06* (2013.01); *A45C 7/0077* (2013.01); *A45C 13/30* (2013.01); *A45C 2013/306* (2013.01)

(58) Field of Classification Search
CPC ..... A45C 2013/306; A45C 2013/30; A45C 7/0086; A45C 3/06; B65D 63/00; B65D 63/10
USPC ..... 150/111, 113, 107; 383/37; 220/23.86, 220/23.83, 23.4
See application file for complete search history.

(56) References Cited

U.S. PATENT DOCUMENTS 2,550,199 A * 4/1951 Moss ..... A45C 3/06 190/107
5,008,987 A * 4/1991 Armour, II ..... A44B 18/00 24/442
5,050,713 A * 9/1991 Lee ..... A45F 3/02 150/110
5,439,154 A 8/1995 Delligatti
5,713,439 A * 2/1998 Zionts ..... A45C 7/0045 150/108
6,230,771 B1 * 5/2001 Hellenbrand ..... A45C 3/00 190/102
6,668,882 B1 12/2003 Cazes
6,823,909 B1 * 11/2004 Marsteller ..... A45C 7/0086 150/113
7,293,635 B2 11/2007 Repke
9,756,919 B2 * 9/2017 Murdoch ..... A45C 13/30
2013/0333996 A1 * 12/2013 Selvi ..... A45C 13/1092 190/18 A
2015/0122381 A1 5/2015 Morrison
(Continued)

*Primary Examiner* — Robert Poon

(57) ABSTRACT

A multifunctional dual carry bag system comprising a first bag and a second bag, each equipped with side belt loops and a sash or a strap is disclosed. The second bag features an interior cavity with multiple pockets, ideal for organizing smaller items, while the first bag has an open cavity suited for larger items such as laptops and clothing. The bags can be used independently or combined by threading a sash or strap through both sets of belt loops and securing the strap in front, enabling for various carrying configurations, including shoulder, crossbody, and backpack styles. The bags are made from durable materials such as nylon, leather, canvas, polyester, or eco-friendly fabrics. The adjustable sashes or straps can include materials selected from the group consisting of a nylon webbing, a leather strap, and a cotton webbing.

20 Claims, 5 Drawing Sheets

(56) References Cited

U.S. PATENT DOCUMENTS

| | | | | |
|---|---|---|---|---|
| 2015/0157113 | A1* | 6/2015 | Anelevitz | A45C 15/00 224/576 |
| 2017/0181514 | A1* | 6/2017 | Castillo Machado | A45C 13/262 |
| 2019/0216189 | A1* | 7/2019 | Liu | B32B 5/18 |
| 2020/0329839 | A1 | 10/2020 | Chung | |
| 2021/0068513 | A1* | 3/2021 | McCandless | A45C 13/1069 |

* cited by examiner

MULTIFUNCTIONAL DUAL CARRY BAG SYSTEM

CROSS-REFERENCE TO RELATED APPLICATION

The present application claims priority to, and the benefit of, U.S. Provisional Application No. 63/569,421 which was filed on Mar. 25, 2024 and is incorporated herein by reference in its entirety.

FIELD OF THE INVENTION

The present invention generally relates to the field of multifunctional bags. More specifically, the present invention relates to a novel dual carry bag designed to simplify carrying both childcare and personal items. The dual carry bag includes a first bag with multiple internal pockets for organizing baby essentials and a second bag with a large, open cavity for larger items such as laptops and clothing. Both bags feature belt loops and sash or straps that can be used independently or combined into a single unit, enabling various carrying configurations such as shoulder bag, crossbody bag, or backpack. Accordingly, the present disclosure makes specific reference thereto. Nonetheless, it is to be appreciated that aspects of the present invention are also equally applicable to other such as applications, devices, and methods of manufacture.

BACKGROUND

Traveling with children presents numerous challenges, particularly for parents who are required to remember to pack and carry several essential items. The essentials typically include diapers, bottles, food or snacks, clothing, and other childcare necessities. While diaper bags are specifically designed to hold baby items, they often fall short when parents also need to carry additional items such as laptops, work documents, personal belongings, or travel essentials. This frequently results in parents having to juggle multiple bags, such as a diaper bag, backpack, briefcase, suitcase, and purses, which can be cumbersome and exhausting.

Carrying separate bags on both shoulders or in hand can be inconvenient and physically taxing, especially during long trips or daily commutes. The need to manage multiple bags not only complicates mobility but also increases the risk of forgetting crucial items when leaving home. This can lead to frustration and added stress for parents, who must balance the demands of childcare with their personal and professional responsibilities. Individuals desire a solution that combines the functionality of a diaper bag with the versatility of other types of bags.

Therefore, there exists a long-felt need in the art for an improved multifunctional carrying solution for individuals. There is also a long-felt need in the art for a bag system that combines the functionalities of a diaper bag, purse, briefcase, and travel bag into a single, multifunctional unit. Additionally, there is a long-felt need in the art for a carrying solution that alleviates the burden of juggling multiple bags, thereby reducing the physical strain and inconvenience for parents. Moreover, there is a long-felt need in the art for a bag system that provides ample storage and organizational features for both childcare items and personal belongings, ensuring that essential items are easily accessible and less likely to be forgotten. Further, there is a long-felt need in the art for a durable, stylish bag made from high-quality materials. Furthermore, there is a long-felt need in the art for a carrying solution that can be adapted to various configurations, such as shoulder bag, crossbody, or backpack, to suit different carrying preferences and situations. Finally, there is a long-felt need in the art for a multifunctional dual carry bag that enhances convenience, efficiency, and peace of mind for parents on the go, providing a comprehensive solution to the challenges faced during travel and daily activities with children. The subject matter disclosed and claimed herein, in one embodiment thereof, comprises a multifunctional and combined dual carry bag. The carry bag comprises a first bag having at least a pair of belt loops disposed on side surfaces thereof, the first bag further includes an interior cavity with a plurality of pockets, a second bag having at least a pair of belt loops disposed on side surfaces thereof, the second bag further includes an interior cavity without pockets, a first sash or strap is configured to be looped through the belt loops of the first bag and tied along a front surface of the first bag, and a second sash or strap configured to be looped through the belt loops of the second bag and through the belt loops of the first bag, the second sash or strap is tied along a front surface of the second bag or rear surface of the first bag, wherein the second sash or strap supports both the first bag and the second bag in a combined state for simultaneous use. In this manner, the multifunctional dual carry bag of the present invention accomplishes all of the foregoing objectives and provides users with a novel solution for carrying and organizing both childcare items and personal belongings. The dual carry bag includes a first bag with multiple internal pockets specifically designed for organizing items such as lotions, powders, bottles, and other childcare necessities. The second bag features a spacious interior cavity without pockets, suitable for carrying larger items such as laptops, books, and clothing. Both bags are equipped with belt loops on the side surfaces and sash or straps that can be looped through these loops, enabling the bags to be used independently or combined into a single unit. The sash or straps can be tied in various configurations, enabling the bags to be carried as a shoulder bag, crossbody bag, or backpack. The bag provides ample storage and organizational features for both childcare items and personal belongings, ensuring that essential items are easily accessible and less likely to be forgotten.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multifunctional dual carry bag. The bag comprises a first bag having a pair of belt loops disposed on side surfaces thereof, the first bag further includes an interior cavity with a plurality of pockets, a second bag having a pair of belt loops disposed on side surfaces thereof, the second bag further includes an interior cavity without pockets, a first sash or strap is configured to be looped through the belt loops of the first bag and tied along a front surface of the first bag, and a second sash or strap configured to be looped through the belt loops of the second bag and through the belt loops of the first bag, the second sash or strap is tied along a front surface of the second bag or rear surface of the first bag, wherein the second sash or strap supports both the first bag and the second bag in a combined state for simultaneous use.

In yet another embodiment, the multifunctional bag system comprises a first bag having a pair of belt loops disposed on side surfaces thereof and an interior cavity with a plurality of pockets, the first bag is configured for independent use by looping and tying a sash or strap through the belt loops of the first bag, and a second bag having a pair of belt loops disposed on side surfaces thereof and an interior cavity without pockets, the second bag is configured for independent use by looping and tying a sash or strap through the belt loops of the second bag.

In another embodiment, a method of configuring a multifunctional dual carry bag system is disclosed. The method comprises the steps of providing a first bag having a pair of belt loops disposed on side surfaces thereof and a first sash or strap looped through the belt loops and tied along a front surface of the first bag, providing a second bag having a pair of belt loops disposed on side surfaces thereof and a second sash or strap looped through the belt loops and tied along a front surface of the second bag, untying the sash or strap of one of the bags, positioning the untied bag such that the sash or strap of the other bag faces inward, threading the untied sash or strap through the belt loops of both bags, and tying the untied sash or strap in front of one of the bags to combine the first and second bags for simultaneous use.

In still another embodiment, the first bag and the second bag are made from materials selected from the group consisting of nylon, leather, canvas, polyester, and eco-friendly fabrics.

In another aspect, the first sash or strap and the second sash or strap are made from materials selected from the group consisting of nylon webbing, leather straps, and cotton webbing.

In yet another aspect, an insulated pocket is disposed within the interior cavity of the first bag for storing temperature-sensitive items.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
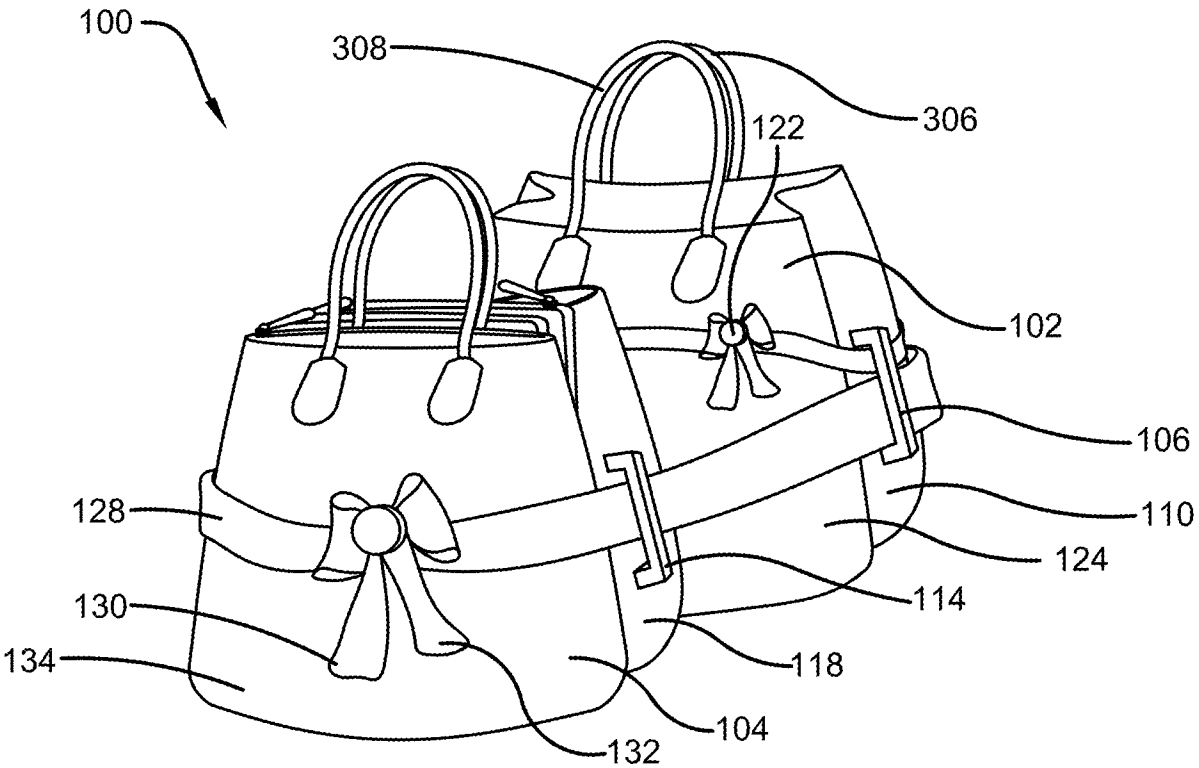
FIG. 1 illustrates a perspective view of the multifunctional dual carry bag of the present invention in a combined state in accordance with the disclosed structure.

The innovation is now described with reference to the drawings, wherein such as reference numerals are used to refer to such as elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved multifunctional carrying solution for individuals. There is also a long-felt need in the art for a bag system that combines the functionalities of a diaper bag, purse, briefcase, and travel bag into a single, multifunctional unit. Additionally, there is a long-felt need in the art for a carrying solution that alleviates the burden of juggling multiple bags, thereby reducing the physical strain and inconvenience for parents. Moreover, there is a long-felt need in the art for a bag system that provides ample storage and organizational features for both childcare items and personal belongings, ensuring that essential items are easily accessible and less likely to be forgotten. Further, there is a long-felt need in the art for a durable, stylish bag made from high-quality materials. Furthermore, there is a long-felt need in the art for a carrying solution that can be adapted to various configurations, such as shoulder bag, crossbody, or backpack, to suit different carrying preferences and situations. Finally, there is a long-felt need in the art for a multifunctional dual carry bag that enhances convenience, efficiency, and peace of mind for parents on the go, providing a comprehensive solution to the challenges faced during travel and daily activities with children. Further, once a diaper bag is no longer needed, the device may be utilized as a purse or other type of bag. The pockets may be used for soda cans or any other product desired by the user.

The present invention, in one exemplary embodiment, is a method of configuring a multifunctional dual carry bag system. The method comprises the steps of providing a first bag having a pair of belt loops disposed on side surfaces thereof and a first sash or strap looped through the belt loops and tied along a front surface of the first bag, providing a second bag having a pair of belt loops disposed on side surfaces thereof and a second sash or strap looped through the belt loops and tied along a front surface of the second bag, untying the sash or strap of one of the bags, positioning the untied bag such that the sash or strap of the other bag faces inward, threading the untied sash or strap through the belt loops of both bags, and tying the untied sash or strap in front of one of the bags to combine the first and second bags for simultaneous use.

Reference will now be made in detail to the present preferred embodiments of the invention, examples of which are illustrated in the accompanying drawings. Wherever possible, the same reference numerals are used in the drawings and the description to refer to the same or such as parts.

Referring initially to the drawings, FIG. 1 illustrates a perspective view of the multifunctional dual carry bag of the present invention in a combined state in accordance with the disclosed structure. The multifunctional dual carry bag 100 of the present invention is designed as an innovative, multifunctional bag designed to serve various purposes. More specifically, the dual carry bag 100 includes a first bag 102 and a second bag 104, wherein the bags 102, 104 are preferably different and more preferably, the first bag 102 is adapted to carry big items such as clothing, laptops, and more and the second bag 104 is configured for organizing items such as lotion, powder, bottles, and other childcare necessities.

The bags 102, 104 are adapted to be used independently as well. The first bag 102 includes a pair of belt loops 106, 108 disposed on the side surface 110, 112 thereof. Similarly, the second bag 104 includes a pair of belt loops 114, 116 disposed on the corresponding side surfaces 118, 120 thereof. In the combined state as illustrated in FIG. 1, a first sash or strap 122 is looped through the belt loops 106, 108 to tie along the front surface 124 of the first bag 102. The first bag 102 is positioned such that the front surface 124 of the first bag 102 faces the rear surface 126 of the second bag 104. A second sash or strap 128 is passed through the loops 114, 116 of the second bag 104 and is also passed through the loops 106, 108 of the first bag 102 such that the free ends 130, 132 of the second sash or strap 128 is tied along the front surface 134 of the second bag 104.

The second sash or strap 128 supports both the bags 102, 104 and the bags 102, 104 can be carried and used simultaneously. It will be apparent to a person skilled in the art that the first sash or strap 122 can also be passed through the loop belts 106, 108 of the first bag 102 and loop belts 114, 116 of the second bag 104. In the preferred embodiment, the bag whose sash or strap is tied across the belt loops of both the bags 102, 104 supports and detachably connects both the bags 102, 104.

Figure 2:
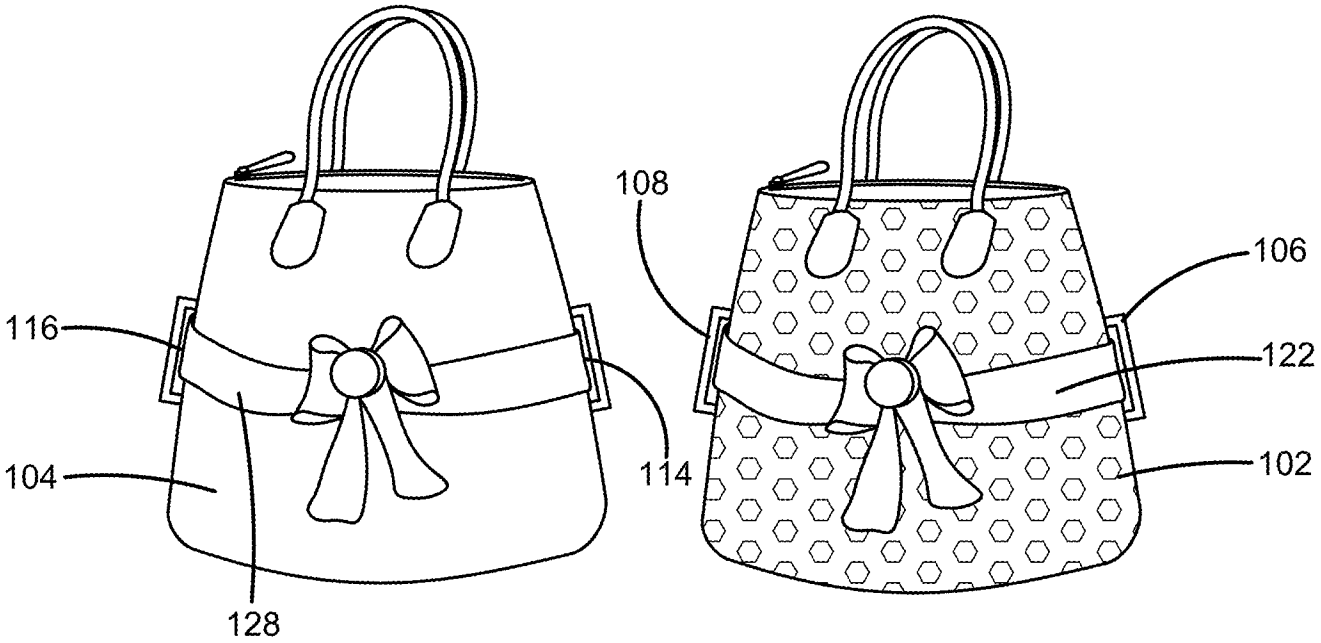
FIG. 2 illustrates a perspective view showing the individual carry bags of the present invention in an untied and separate position in accordance with the disclosed structure.

FIG. 2 illustrates a perspective view showing the individual carry bags of the present invention in an untied and separate position in accordance with the disclosed structure. Each bag 102, 104 of the dual bag 100 can be used separately based on the need of users. In one non-limiting example, a user can use the first bag 102 for work-related purposes and the second bag 104 with a day out with the baby. As illustrated, in untied or separate orientation, the sash or strap 122 is tied independently to the first bag 102 and is passed through the belt loops 106, 108 and tied, enabling a user to use the first bag 102 independently. Similarly, the sash or strap 128 is looped through the belt loops 114, 116 and is tied to use the second bag 104 separately.

Figure 3:
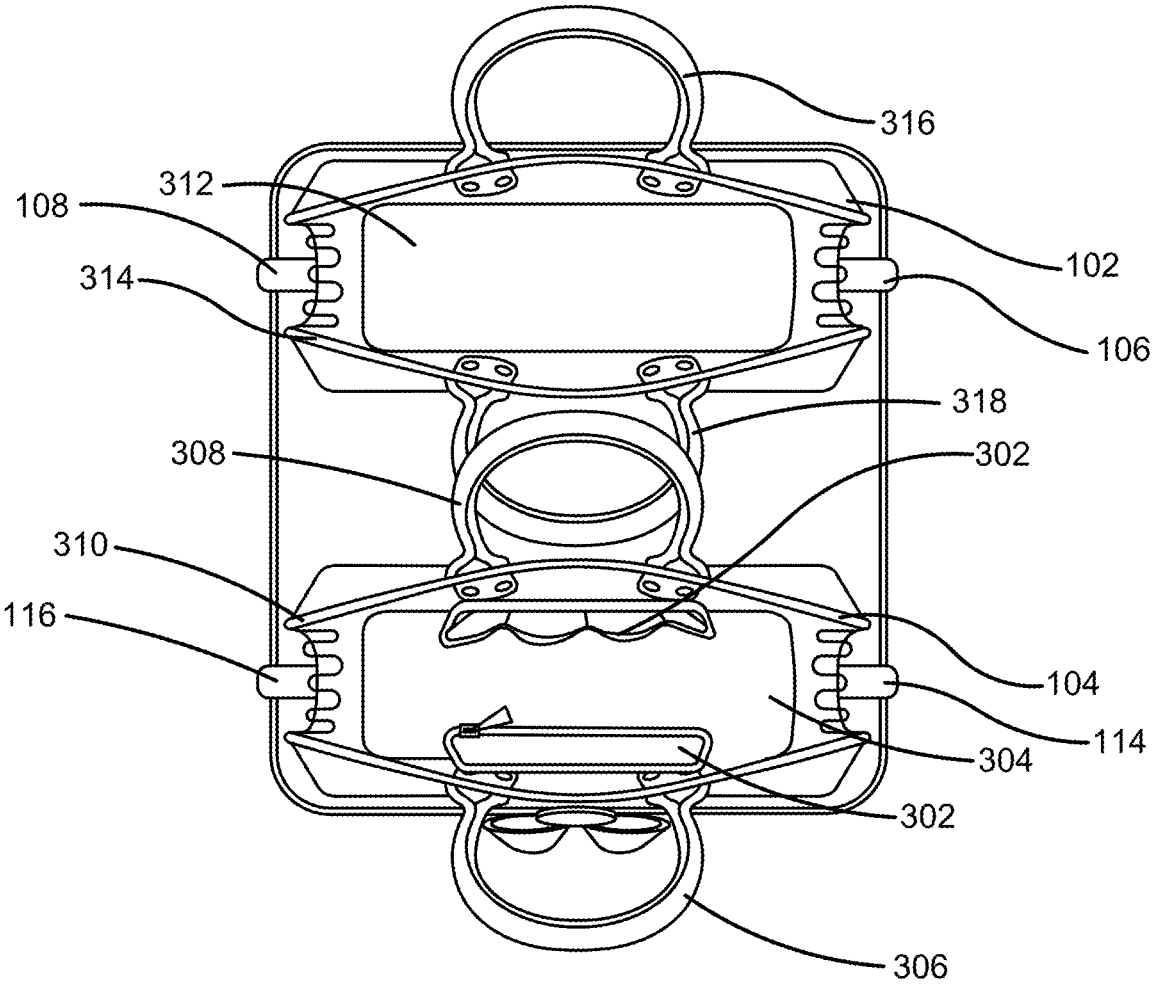
FIG. 3 illustrates a top perspective view of the dual bag of the present invention in accordance with one embodiment of the disclosed structure.

FIG. 3 illustrates a top perspective view of the dual bag of the present invention in accordance with one embodiment of the disclosed structure. As illustrated, the second bag 104 includes a plurality of pockets 302 disposed inside the cavity 304 of the second bag 104. The second bag 104 can be folded when not used and includes a pair of handles 306, 308. The cavity 304 can be closed using a zipper, magnetic fastener, snap button, or any other conventional fastener disposed at the top end 310 of the second bag 104. The loops 114, 116 can be integrated to the side surfaces 118, 120 and can also be slidably attached to the side surfaces 118, 120.

The second bag 104 includes a large cavity 312 and does not include any pockets, therefore is utilized to carry laptops, books, and other big items. The second bag 104 can be closed using a fastener disposed along the top end 314 of the second bag 104. A sash or strap of one of the sashes or straps 122, 128 can be looped along the belt loops 106, 108, 114, 116 for connecting both the bags 102, 104. The second bag 104 contains the handles 316, 318.

Figure 4:
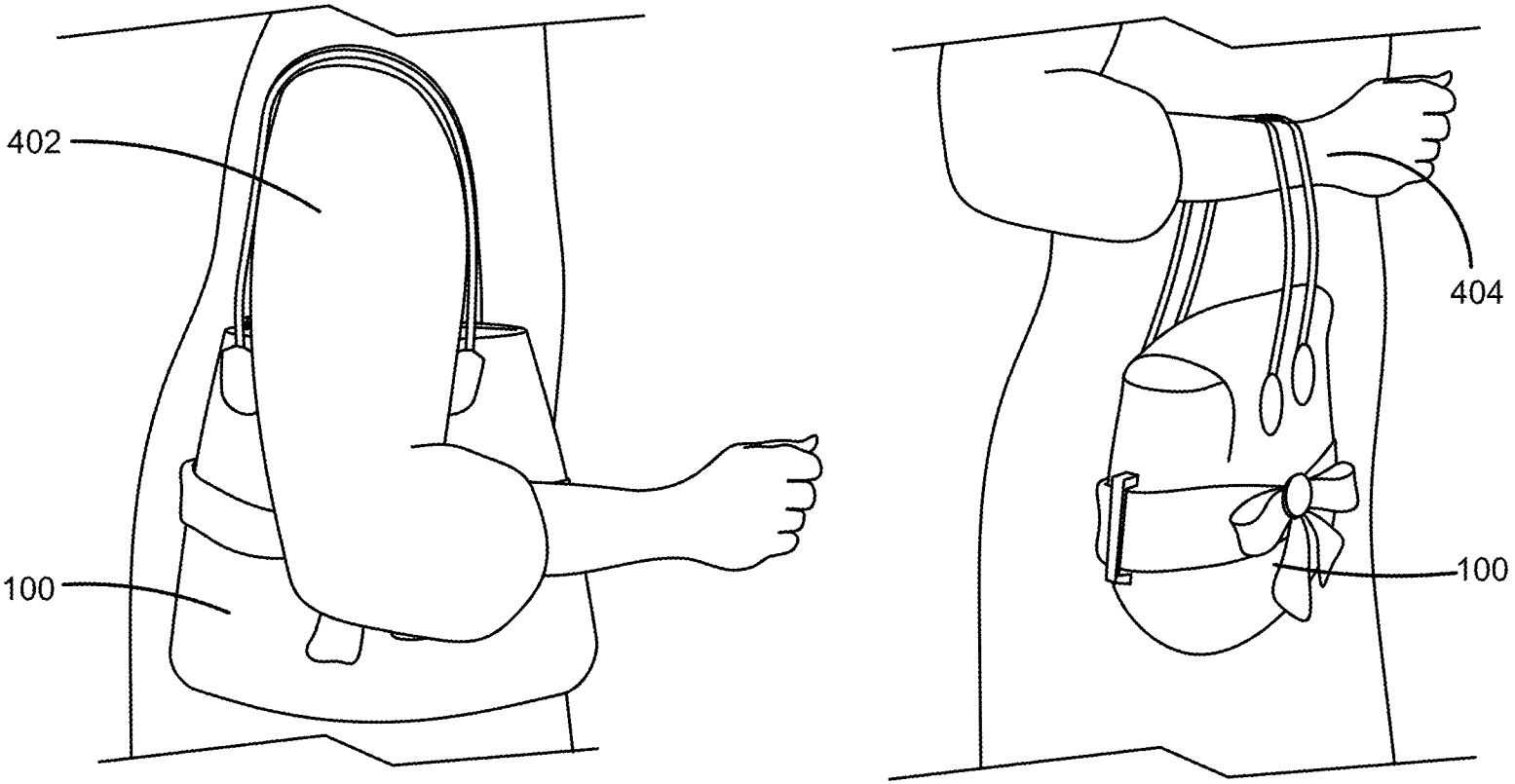
FIG. 4 illustrates a perspective view showing a user carrying the dual bag of the present invention in accordance with disclosed structure.

FIG. 4 illustrates a perspective view showing a user carrying the dual bag of the present invention in accordance with disclosed structure. The convertible combination and independent use carry bags 100 can be carried such as a conventional bag on shoulder 402 and in arm 404. Further, the dual bag 100 includes one of the sashes or straps 122, 128 tied through the loops 106, 108, 114, 116 and is tied in front surface of one of the bags for aesthetic value.

Figure 5:
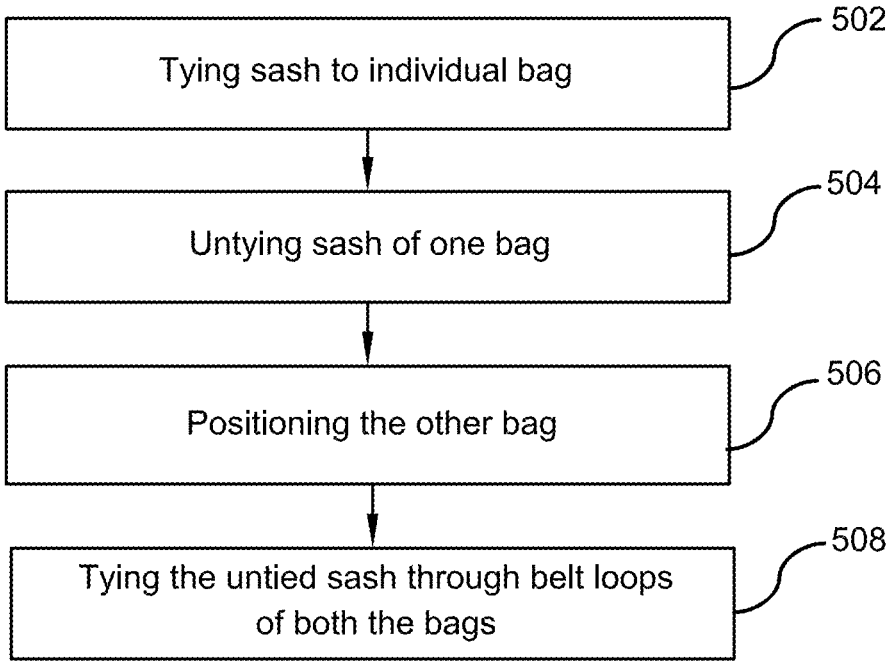
FIG. 5 illustrates a flow chart depicting a process of setting up the dual bag of the present invention in accordance with one embodiment of the present invention.

FIG. 5 illustrates a flow chart depicting a process of setting up the multifunctional dual carry bag system of the present invention in accordance with one embodiment of the present invention. Initially, each bag is separable with the corresponding sash or strap thereof tied through the corresponding belt loops (Step 502). Thereafter, one (first bag) of the bags 102, 104 is chosen and the sash or strap of the chosen bag is untied (Step 504). Then, the other bag (second bag) is positioned such that the tied sash or strap of the other bag faces inward (towards the first bag) (Step 506). Thereafter, the untied sash or strap of the first bag is threaded through the belt loops of the second bag as well and is tied in front of the second bag or alternatively in front of the first bag (Step 508). The combined bags can be worn or carried as a single unit. The tied sash or strap in the front provides a secure way to carry both bags together. To separate the bags, the tied sash or strap can be untied to unsecure the bags 102, 104.

In one example, the internal pockets of the first bag 102 can be used for storing for baby items and the second bag 104 can be used for storing personal items such as wallet, phone, and keys. Each bag can be used separately based on the need. For example, a user can use the bag with pockets for a day out with the baby and the bag without pockets for work-related purposes. Both the bags 102, 104 can be combined using the sashes or straps 122, 128 to provide a larger and more organized carrying solution.

In one embodiment, one of the sashes or straps is longer in length and can be used for carrying the convertible combination and independent use carry bags 100 as a shoulder bag (i.e., strap 128 used as a shoulder strap), crossbody (i.e., strap 128 used as a crossbody strap), backpack (i.e., strap 128 used as a backpack strap). In some embodiments, the internal pockets of the bags can be detached and at least one of the pockets is insulated for storing temperature-sensitive items such as baby bottles or snacks.

The bags 102, 104 can be made from nylon, leather, canvas, polyester, or eco-friendly fabrics. The sash or straps may come in different colors and designs and can be made from nylon webbing, leather straps, cotton webbing, and more.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "multifunctional dual carry bag system", "multifunctional dual carry bag", "convertible combination and independent use carry bags", and "dual bag" are interchangeable and refer to the convertible combination and independent use carry bags 100 of the present invention.

Notwithstanding the forgoing, the convertible combination and independent use carry bags 100 of the present invention can be of any suitable size and configuration as is known in the art without affecting the overall concept of the invention, provided that it accomplishes the above stated objectives. One of ordinary skill in the art will appreciate that the convertible combination and independent use carry bags 100 as shown in the FIGS. are for illustrative purposes only, and that many other sizes and shapes of the convertible combination and independent use carry bags 100 are well within the scope of the present disclosure. Although the dimensions of the convertible combination and independent use carry bags 100 are important design parameters for user convenience, the convertible combination and independent use carry bags 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A dual carry bag device comprising:
a first bag having a first volume;
a second bag having a second volume;
a first strap; and
a second strap;
wherein said first volume is different than said second volume;
wherein said first bag configured to carry items selected from the group consisting of a clothing, a book, and a laptop;
wherein said second bag configured for organizing items selected from the group consisting of a lotion, a powder, a diaper, a food item, and a bottle;
wherein said first bag selectively attachable to said second bag;
wherein said first bag having a first pair of loops including a first loop on one side of said first bag and a second loop on an opposing side of said first bag;
wherein said second bag having a second pair of loops including a first loop on one side of said second bag and a second loop on an opposing side of said second bag;
wherein said first strap looped through said first loop and said second loop of said first bag;
wherein said second strap looped through said first loop and said second loop of said first bag, and looped through said first loop and said second loop of said second bag; and
further wherein a front surface of said first bag positioned adjacent to a rear surface of said second bag.

2. The dual carry bag device of claim 1, wherein said first bag and said second bag selectively detachable for independent carry of said first bag and said second bag.

3. The dual carry bag device of claim 2, wherein said second strap supports said first bag and said second bag for carrying simultaneously said first bag and said second bag.

4. The dual carry bag device of claim 3, wherein said first strap looped through said first loop and said second loop of said first bag, and looped through said first loop and said second loop of said second bag.

5. The dual carry bag device of claim 4, wherein said first bag selectively separable from said second bag for independent use of said first bag and said second bag.

6. The dual carry bag device of claim 5, wherein said first strap is secured to said first bag when said first bag is separated from said second bag.

7. The dual carry bag device of claim 6, wherein said second strap is secured to said second bag when said second bag is separated from said first bag.

8. The dual carry bag device of claim 7, wherein said first bag is foldable.

9. The dual carry bag device of claim 8, wherein said first loop and said second loop slidably attached respectively to said first side and said second side of said first bag.

10. A dual carry bag device comprising:
a first bag having a first volume;
a second bag having a second volume;
a first strap having a first length; and
a second strap having a second length;
wherein said first volume is different than said second volume;
wherein said second length is longer than said first length;
wherein said first bag configured to carry items selected from the group consisting of a clothing, a book, and a laptop;
wherein said second bag configured for organizing items selected from the group consisting of a lotion, a powder, a diaper, a food item, and a bottle;
wherein said first bag selectively attachable to said second bag;
wherein said first bag having a first pair of loops including a first loop on one side of said first bag and a second loop on an opposing side of said first bag;
wherein said second bag having a second pair of loops including a first loop on one side of said second bag and a second loop on an opposing side of said second bag;
wherein said first strap looped through said first loop and said second loop of said first bag;
wherein said second strap looped through said first loop and said second loop of said first bag, and looped through said first loop and said second loop of said second bag;

wherein a front surface of said first bag positioned adjacent to a rear surface of said second bag; and further wherein said second strap is a shoulder strap.

11. The dual carry bag device of claim 10, wherein said first bag and said second bag selectively detachable for independent carry of said first bag and said second bag.

12. The dual carry bag device of claim 11, wherein said second strap supports said first bag and said second bag for carrying simultaneously said first bag and said second bag.

13. The dual carry bag device of claim 12, wherein said first strap looped through said first loop and said second loop of said first bag, and looped through said first loop and said second loop of said second bag.

14. The dual carry bag device of claim 13, wherein said first bag selectively separable from said second bag for independent use of said first bag and said second bag.

15. The dual carry bag device of claim 14, wherein said first strap is secured to said first bag when said first bag is separated from said second bag.

16. The dual carry bag device of claim 15, wherein said second strap is secured to said second bag when said second bag is separated from said first bag.

17. The dual carry bag device of claim 16, wherein said first bag is foldable.

18. The dual carry bag device of claim 17, wherein said first loop and said second loop slidably attached respectively to said first side and said second side of said first bag.

19. A method of selectively carrying dual bags, the method comprising the steps of:

providing a first bag having a first volume, a second bag having a second volume, a first strap having a first length, and a second strap having a second length, wherein said first volume is different than said second volume, further wherein said second length is longer than said first length;

carrying items selected from the group consisting of a clothing, a book, and a laptop in said first bag;

carrying items selected from the group consisting of a lotion, a powder, a diaper, a food item, and a bottle in said second bag;

selectively attaching said first bag to said second bag, wherein said first bag having a first pair of loops including a first loop on one side of said first bag and a second loop on an opposing side of said first bag, further wherein said second bag having a second pair of loops including a first loop on one side of said second bag and a second loop on an opposing side of said second bag;

looping said first strap through said first loop and said second loop of said first bag;

looping said second strap through said first loop and said second loop of said first bag, and through said first loop and said second loop of said second bag, wherein a front surface of said first bag positioned adjacent to a rear surface of said second bag; and carrying the attached said first bag and said second bag with said second strap position selected from the group consisting of a shoulder strap, a crossbody strap, and a backpack strap.

20. The method of selectively carrying dual bags of claim 19, wherein said first bag and said second bag selectively detachable for independent carry of said first bag and said second bag.

* * * * *